US009434449B2

(12) United States Patent
Heuton

(10) Patent No.: US 9,434,449 B2
(45) **Date of Patent: *Sep. 6, 2016**

(54) PORTABLE WIND-POWERED SAILING VESSEL

(71) Applicant: Allan D. Heuton, Brookings, SD (US)

(72) Inventor: Allan D. Heuton, Brookings, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/797,836

(22) Filed: Jul. 13, 2015

(65) Prior Publication Data

US 2016/0009343 A1 Jan. 14, 2016

Related U.S. Application Data

(63) Continuation of application No. 13/840,878, filed on Mar. 15, 2013, now Pat. No. 9,079,649.

(51) Int. Cl.

| | |
|---|---|
| ***B63B 17/00*** | (2006.01) |
| ***B63B 7/04*** | (2006.01) |
| ***B63H 9/06*** | (2006.01) |
| ***B63B 7/02*** | (2006.01) |
| ***B63B 35/71*** | (2006.01) |
| ***B63H 9/04*** | (2006.01) |
| ***B63B 1/12*** | (2006.01) |
| *B63B 1/20* | (2006.01) |

(52) U.S. Cl.

CPC ..... *B63B 7/04* (2013.01); *B63B 1/121* (2013.01); *B63B 7/02* (2013.01); *B63B 35/71* (2013.01); *B63H 9/04* (2013.01); *B63H 9/06* (2013.01); *B63B 2001/123* (2013.01); *B63B 2001/208* (2013.01)

(58) Field of Classification Search

CPC ..... B63B 7/00; B63B 17/00
USPC ..... 114/39.26
See application file for complete search history.

(56) References Cited

U.S. PATENT DOCUMENTS

| | | | | |
|---|---|---|---|---|
| 3,141,435 | A | 7/1964 | Moffitt, Jr. | |
| 3,561,388 | A * | 2/1971 | Keiper | B63B 1/30 114/281 |
| 3,802,366 | A * | 4/1974 | Mankawich | B63H 9/0607 114/102.21 |
| 3,820,493 | A | 6/1974 | Amick | |
| 3,839,979 | A | 10/1974 | Wassell | |
| 3,929,085 | A * | 12/1975 | Mason | B63B 1/14 114/123 |
| 4,108,100 | A * | 8/1978 | Jamieson | B63B 15/02 114/102.12 |
| 4,159,006 | A * | 6/1979 | Thurston | B63B 1/14 114/123 |
| 4,294,184 | A * | 10/1981 | Heinrich | B63B 1/125 114/123 |
| 4,474,128 | A * | 10/1984 | Wallach | B63B 1/14 114/123 |
| 4,688,504 | A * | 8/1987 | Sulz | B63B 1/14 114/102.19 |
| 4,730,570 | A * | 3/1988 | Harris | B63B 1/14 114/123 |
| 4,771,716 | A | 9/1988 | Dat | |
| 4,836,120 | A * | 6/1989 | Murphy | B63C 7/003 114/125 |
| 4,878,447 | A * | 11/1989 | Thurston | B63B 1/14 114/123 |
| 5,024,177 | A | 6/1991 | Winter et al. | |
| 5,031,557 | A * | 7/1991 | Farrier | B63B 1/14 114/61.16 |

(Continued)

*Primary Examiner* — Lars A Olson
*Assistant Examiner* — Jovon Hayes
(74) *Attorney, Agent, or Firm* — Suiter Swantz pc llo

(57) ABSTRACT

A portable wind-powered sailing vessel includes a plurality of parallel hulls, a plurality of cross-member spars releasably connecting the parallel hulls, a central longitudinal body centrally located between the parallel hulls and releasably connected to the plurality of cross-member spars, a crew seat releasably connected to the central longitudinal body forward of a mast, a kick-up rudder assembly and a foot pedal steering system both releasably connected to the longitudinal body, a rudder releasably connected to the kick-up rudder assembly, and a main sail on the mast, and a jib.

20 Claims, 12 Drawing Sheets

(56) References Cited

U.S. PATENT DOCUMENTS 5,231,943 A * 8/1993 Benze ..... B26B 15/002 114/102.16
5,235,925 A * 8/1993 Farrier ..... B63B 1/14 114/123
5,423,274 A * 6/1995 Benze ..... B63B 1/14 114/104
5,427,554 A * 6/1995 Foglia ..... B63B 35/73 114/39.21
5,580,288 A * 12/1996 Marinc ..... B63H 16/14 440/29
5,582,126 A * 12/1996 Rypinski ..... B63B 1/125 114/352
5,617,805 A * 4/1997 Frigard ..... B63B 1/125 114/141
D380,187 S 6/1997 Brown
5,651,706 A * 7/1997 Kasper ..... B63B 7/082 114/354
5,904,111 A * 5/1999 Frigard ..... B63B 1/125 114/144 R
5,957,071 A * 9/1999 Brock ..... B63B 1/10 114/39.11
6,024,041 A * 2/2000 Eglais ..... B63B 1/24 114/274
6,240,865 B1 * 6/2001 Hubbard ..... B63B 1/125 114/39.28
6,311,635 B1 * 11/2001 Vaton ..... B63B 1/125 114/272
6,345,582 B1 * 2/2002 Dudink ..... B63B 1/121 114/347
6,575,107 B1 * 6/2003 Fernandez Puentes ..... B63B 1/14 114/102.16
6,578,507 B1 * 6/2003 Bergmark ..... B63B 1/322 114/272
6,581,536 B1 * 6/2003 Belloso ..... B60V 1/08 114/274
6,732,670 B2 * 5/2004 Rayner ..... B63H 9/0685 114/39.21
6,851,378 B2 * 2/2005 Amory ..... B63B 1/121 114/39.28
6,860,215 B2 * 3/2005 Dawson ..... B63B 1/121 114/123
6,959,659 B1 * 11/2005 Burrell ..... B63B 1/125 114/39.27
6,990,915 B2 * 1/2006 Smith ..... B63B 1/14 114/61.16
7,137,349 B2 * 11/2006 Morelock ..... B63B 1/121 114/354
7,234,404 B2 * 6/2007 Tissier ..... B63B 1/121 114/39.26
7,931,512 B2 * 4/2011 Bortsov ..... B63H 16/14 440/30
8,668,536 B1 * 3/2014 Burnham ..... B63H 16/18 440/15
8,695,520 B1 * 4/2014 Berte' ..... B63B 1/14 114/39.27
9,079,649 B2 * 7/2015 Heuton ..... B63H 9/06
2004/0261678 A1 12/2004 Morelock et al.
2008/0060569 A1 * 3/2008 Howard ..... B63B 35/71 114/347

* cited by examiner

PORTABLE WIND-POWERED SAILING VESSEL

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a continuation patent application of United States Non-Provisional Patent Application entitled A PORTABLE WIND-POWERED SAILING VESSEL, naming Allan D. Heuton, as inventor, filed Mar. 15, 2013, application Ser. No. 13/840,878, which is incorporated herein by reference in its entirety.

TECHNICAL FIELD

The present invention relates to the field of sail vessels, such as sailboats, having multiple hulls, such as catamarans. In particular, the present invention relates to sailing vessel design configurations that provide vessel transportability, vessel assembly, user visibility and operational simplicity.

BACKGROUND

Multiple variations of small sailing craft, car top-able or trailer-able, have been developed in an attempt simplify the overall sailing experience and introduce new consumers of all ages to the sport and leisure activity. Most simplification attempts have involved assembly processes, transportability features related to bulk and weight, and variations of kick-up rudders. Other variations attempt to enhance stability through the deployment of outriggers, hydrofoils, or specialized mast and sail rigging. Variations of mono-hull, catamaran and tri-hull designs are well known in the present marketplace.

Mono-hull car-top sailboat hulls are of the planing hull variety but are bulky, difficult to car-top by one person, and highly unstable when sailed for speed requiring frequent shifting of crew weight to provide stability. Multi-hull car-top catamarans employ wave piercing displacement hulls, having a tendency to pitch-pole as a result, and require frequent shifting of crew weight to provide lateral and longitudinal stability. Some catamarans incorporate a hull design that is capable of planing, but in a severe laterally canted position referred to as "flying a hull" where one hull is raised completely out of the water and extreme shifts in crew weight and position are required to remain upright. Tri-hull designs generally provide more stability through the deployment of outriggers to provide a wide beam but must be trailered, and require significant assembly time. In all varieties of car-top sailboats the crew is seated toward the stern of the boat, and behind the mast, which restricts forward visibility. Frequently cited negative characteristics include a wet sailing experience, instability and easy to capsize, and pitch polling (poor longitudinal stability). Small sailboats in the present marketplace, and published designs, fail to address in one product, many of the cited negative characteristics and do not incorporate all of the positive characteristics. The present invention is directed toward improvements in multi-hull sail boats, particularly to those of the catamaran class.

SUMMARY

A portable wind-powered sailing vessel is disclosed. In one aspect, the sailing vessel may include, but is not limited to, a plurality of parallel hulls; a plurality of cross-member spars releasably connecting the parallel hulls; a central longitudinal body centrally located between the parallel hulls and releasably connected to the plurality of cross-member spars; a crew seat releasably connected to the central longitudinal body forward of a mast; a kick-up rudder assembly and a foot pedal steering system both releasably connected to the longitudinal body; a rudder releasably connected to the kick-up rudder assembly; and a main sail on the mast, and a jib.

In another aspect, the sailing vessel may include, but is not limited to, a plurality of parallel hulls; a plurality of cross-member spars releasably connecting the parallel hulls; a central longitudinal body centrally located between the parallel hulls and releasably connected to the plurality of cross-member spars; a crew seat releasably connected to the central longitudinal body forward of a mast; a kick-up rudder assembly and a foot pedal steering system both releasably connected to the longitudinal body; a rudder releasably connected to the kick-up rudder assembly; and a main sail on the mast, and a jib, wherein the sailing vessel has a weight less than one hundred forty pounds.

In another aspect, the sailing vessel may include, but is not limited to, a plurality of parallel hulls; a plurality of cross-member spars releasably connecting the parallel hulls; a central longitudinal body centrally located between the parallel hulls and releasably connected to the plurality of cross-member spars; a crew seat releasably connected to the central longitudinal body forward of a mast; a kick-up rudder assembly and a foot pedal steering system both releasably connected to the longitudinal body; a rudder releasably connected to the kick-up rudder assembly; and a main sail on the mast, and a jib, wherein the sailing vessel has center of gravity located behind the center of hull buoyancy.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1:
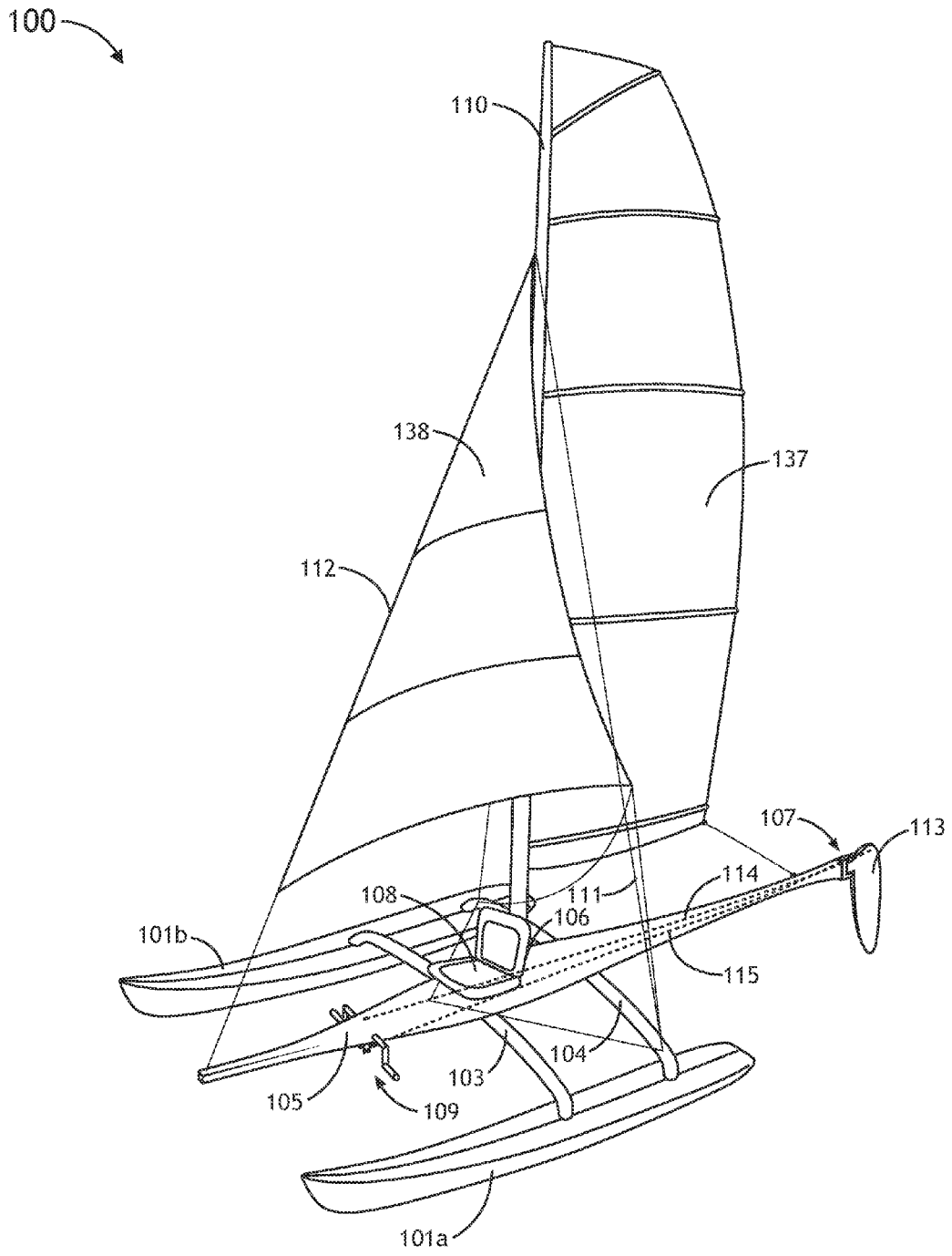
FIG. 1 is a schematic view of the assembled sailing vessel, in accordance with one embodiment of the present invention.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention. Reference will now be made in detail to the subject matter disclosed, which is illustrated in the accompanying drawings.

Referring generally to FIGS. 1 through 8, a portable wind-powered sailing vessel 100 is described in accordance with present disclosure. In one aspect, the present invention is directed toward a portable sailboat 100 configured for reversible assembly and/or disassembly. In a further aspect, the present invention is assembled with a small number of components for ease of transport, storage and assembly. Due to the unique design of the various embodiments of the sailing vessel 100 of the present invention, Applicant has shown operational configurations of the present invention including as few as seven components or assemblies, with the heaviest component or assembly weighing only approximately 40 pounds. In turn, Applicant has shown that in some embodiments the vessel 100 of the present invention may have a weight equal to or less than 140 pounds. In this regard, the small number, weight and compact nature of the various individual components of the vessel 100 of the present invention allow for efficient transportability (e.g., car-top transportability), assembly and storage. For instance, Applicant has shown that embodiments of the vessel 100 of the present invention may be assembled and disassembled by one person using no tools. The present invention described herein allows for ease of assembly, transport and storage, greater visibility, improved lateral and longitudinal stability and comfort and operational simplicity for novices and skilled sailors.

In one aspect of the present invention, the sailing vessel 100 may include a set of parallel hulls. For example, the sailing vessel 100 may include, but is not limited to, left and right parallel hulls. In another aspect, the sailing vessel 100 may include a set of cross-member spars releasably connecting the parallel hulls. For example, the sailing vessel 100 may include, but is not limited to, fore and aft arced spars attached substantially perpendicularly to the left and right parallel hulls of the sailing vessel 100. In another aspect, the sailing vessel 100 may include a longitudinal body centrally located between the parallel hulls and releasably connected to the set of cross-member spars. In another aspect, the sailing vessel 100 may include a crew seat releasably connected to the central longitudinal body at a position forward of the mast of the vessel. For example, the sailing vessel 100 may include, but is not limited to, a central longitudinal body assembly attached perpendicularly to the fore and aft spars and located centrally between the left and right parallel hulls to which are attached a collapsible seat situated in front of the mast location. In another aspect, the sailing vessel 100 may include a kick-up rudder assembly and a foot pedal steering system both releasably connected to the longitudinal body. For example, the sailing vessel 100 may include, but is not limited to, a single kick-up rudder assembly situated at the stern of the central longitudinal body and connected to a foot pedal steering mechanism also attached to the central longitudinal body. In another aspect, the sailing vessel 100 may include a rudder releasably connected to the kick-up rudder assembly. In another aspect, the sailing vessel 100 may include a main sail on the mast, and a jib. For example, the sailing vessel 100 may include, but is not limited to, a mast assembly with side-stays and a forestay, and a sail assembly consisting of a fully battened, boom-less mainsail, and a jib. The remainder of the present disclosure will describe various aspects of the sailing vessel 100 of the present invention. While the following and foregoing description of the sailing vessel 100 illustrates one or more configurations of the sailing vessel 100, it is recognized herein that the sailing vessel 100 is not limited to the illustrated embodiments of the present disclosure. Applicant notes that for the purposes of the present disclosure the terms "sailing vessel" and "sail boat" are used interchangeably.

FIG.1 illustrates a schematic view of the assembled sailing vessel 100, in accordance with one embodiment of the present invention. In one embodiment, the sailboat 100 includes a parallel left hull 101*a* and right hull 101*b*. It is noted herein that the use of the terms "left" and "right" is with respect to a user in the seated position of seat 108. In another embodiment, the sailboat 100 includes an arced fore spar 103 and arced aft spar 104 perpendicular to, and releasably and opposingly connected to, the parallel hulls 101*a* and 101*b*. In another embodiment, the sailboat 100 includes a central longitudinal body 105 arranged perpendicular to and releasably connected to the spars 103 and 104. In another embodiment, the sailboat 100 includes a mast base 106. In another embodiment, the sailboat includes a kick-up rudder assembly 107 equipped with a control line or rod 115 releasably connected to the foot pedal steering assembly 109. In another embodiment, the sail boat 100 includes a collapsible crew seat 108. In an additional aspect, the parallel hulls 101*a* and 101*b*, the spars 103 and 104, the mast base 106, the kick-up rudder assembly 107 and the collapsible crew seat 108 are each releasably connectable to the central longitudinal body 105. In another embodiment, the mast 110 is releasably connected to each of the mast base 106, the arced aft spar 104 with side stays 111, and to the central longitudinal body 105 with a forestay 112. In another embodiment, the rudder 113 is releasably connected to the kick-up rudder assembly 107 with a retracting control line 114 terminating at a location on the central longitudinal body 105 at or near the crew seat 108. In a further embodiment, the sail boat assembly 100 includes a fully battened, boom-less, mainsail 137 and a self-furling jib 138.

It is noted herein that the assembly of the sail boat 100 of the present invention does not require tools, bolts, knobs, or straps as connecting devices. In this regard, the fore and aft spars 103 and 104 may be joined to the left and right hulls 101*a*, 101*b* utilizing opposing pin-receiver assemblies, which are further held in place by attaching the central body 105 to the fore and aft spars 103, 104 utilizing a pin-receiver assembly, which is further held in place by opposing forces generated by the mast forestay and side-stay connections. In an alternative embodiment, it is recognized herein that the sail boat 100 of the present invention may implement other coupling technologies such as, but not limited to, cam latches, straps, removable pins, pin and Velcro strap combinations, and other attachment means suitable for attaching the spars 103, 104 to the parallel hulls 101*a*, 101*b*.

It is noted herein that the various components and assemblies of the sailboat 100 produce a sailboat beam wide enough to provide a high level of lateral stability and obviate the need for crew shifting.

In another embodiment, the positioning of the crew, the arced spar attachments to the left and right hulls, and the central longitudinal body are configured to provide a center of gravity located behind (e.g., slightly behind) the center of hull buoyancy. It is noted herein that by positioning the center of gravity behind the center of hull buoyancy a high level of longitudinal stability may be achieved. In a further embodiment, the arced spars, the hull connections and central longitudinal body are further configured to provide some structural "twist," which serves to minimize, or at least reduce, the pitch-polling tendencies of rigidly designed catamarans.

It is further noted herein that the collapsible crew seat 108 attached to the central longitudinal body 105 ahead of the mast 110 provides unrestricted forward visibility. Applicant notes that the forward positioned collapsible seat 108 is a novel feature providing significant visibility benefits over the position of the crew behind the mast 110 and sails 137 as found in the prior art. In a further embodiment, the positioning of the crew seat 108 acts to raise the crew vertically from underlying water by a larger degree than crews positioned behind the mast 110 and sails 137, providing a substantially dry sailing experience.

FIGS. 2A-2D illustrate design features of the parallel left hull 101*a* and right hull 101*b*, in accordance with embodiments of the present invention. In one aspect, the left and right parallel hulls 101*a*, 101*b* incorporate aft planing surfaces and combination wave splitting-planing bow surfaces to further minimize pitch-polling tendencies, to which fixed skegs are attached to eliminate the need for raising and lowering dagger boards, thereby providing operational simplicity. Further, the left and right parallel hulls 101*a*, 101*b* are designed with a low vertical profile, improving the transportability of the sailing vessel 100. It is noted that traditional catamaran hull designs in the prior art provide wave piercing bows, minimal stern planing surfaces and are subject to significant pitch-polling.

Figure 2A:
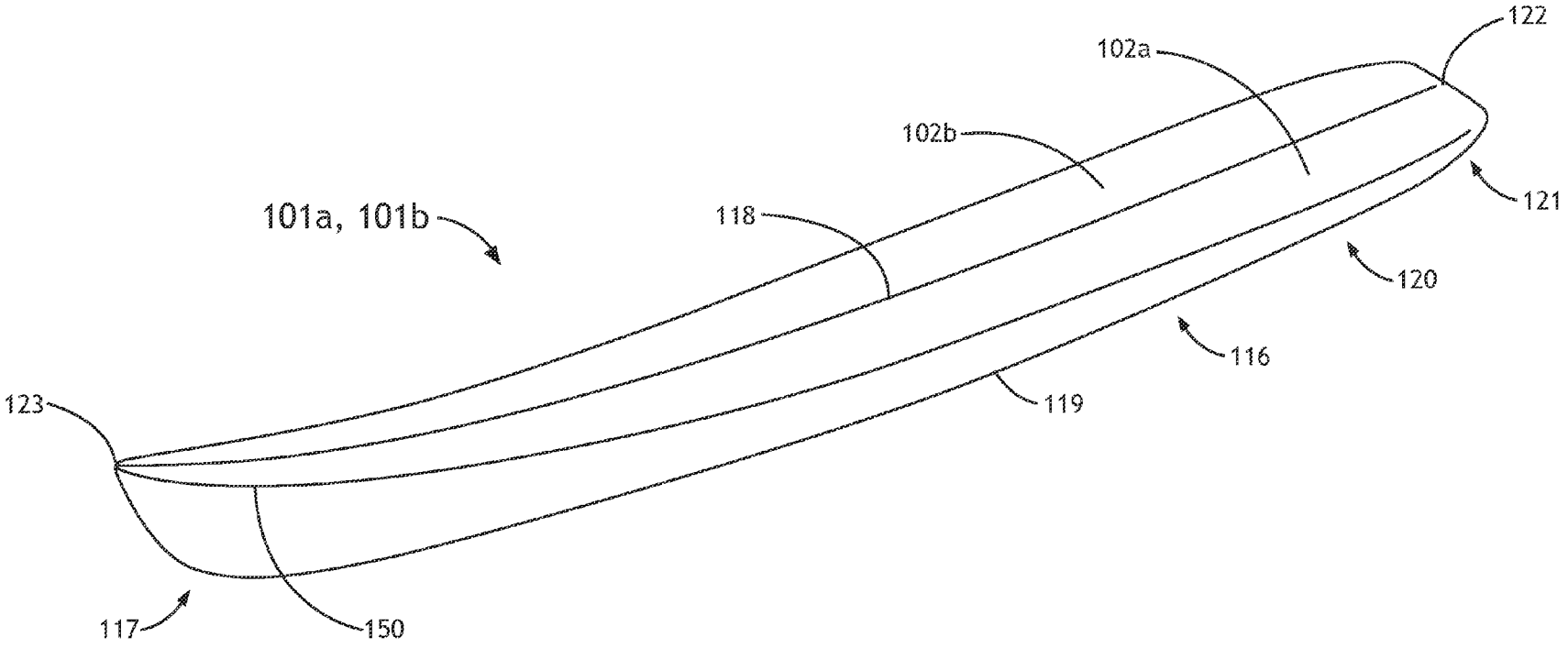
FIG. 2A illustrates design features of the parallel left hull and right hull, in accordance with embodiments of the present invention.

In one embodiment, the left and right hulls 101*a*, 101*b* are constructed of exterior fiberglass. In another embodiment, the left and right hulls 101*a*, 101*b* are constructed of carbon fiber. In another embodiment, the left and right hulls 101*a*, 101*b* are constructed with internal foam. In another embodiment, the left and right hulls 101*a*, 101*b* are shaped to provide a desired stern planing configuration 116 and wave splitting-planing bow configuration 117. In another embodiment, each of the left and right hulls 101*a*, 101*b* are separated into two longitudinal halves, which are affixed to a central stringer 118 formed of a selected material (e.g., wood, PVC, carbon fiber, and the like). In another embodiment, each of the left and right hulls 101*a*, 101*b* includes a stern planing surface 116 extending from the center of hull buoyancy 119 to a wide stern 120, incorporating a slightly raised transom 121 and culminating in a low drag stern profile 122. In another embodiment, a combination wave splitting-planing bow hull shape extends from in front of the center of hull buoyancy 119 to the bow 123, as shown in FIG. 2A.

Figure 2B:
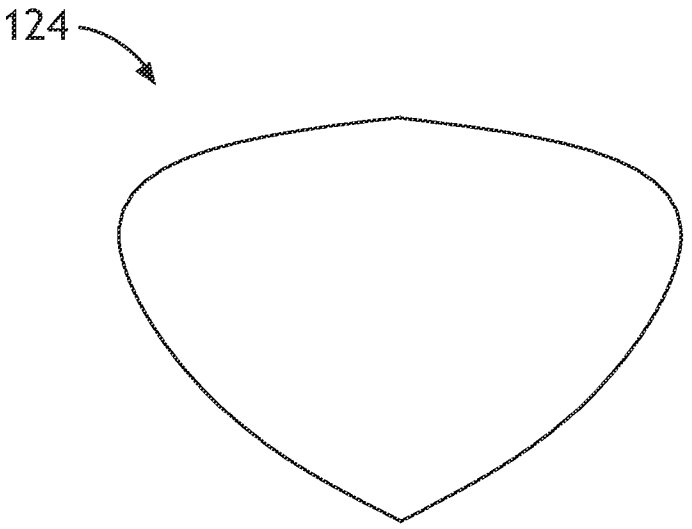
FIG. 2B illustrates design features of the parallel left hull and right hull, in accordance with embodiments of the present invention.
Figure 2C:
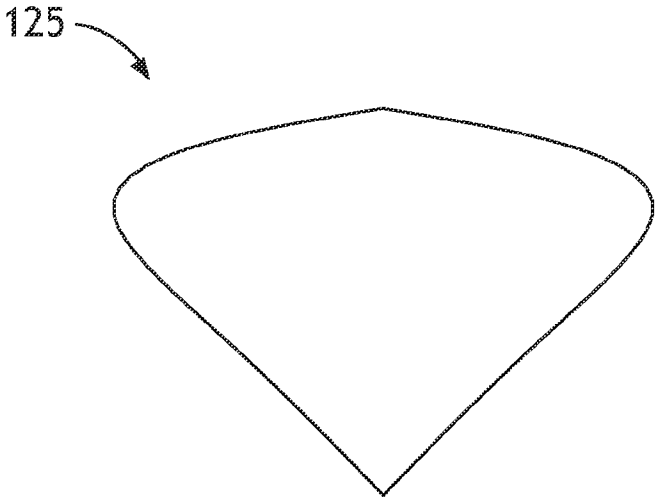
FIG. 2C illustrates design features of the parallel left hull and right hull, in accordance with embodiments of the present invention.
Figure 2D:
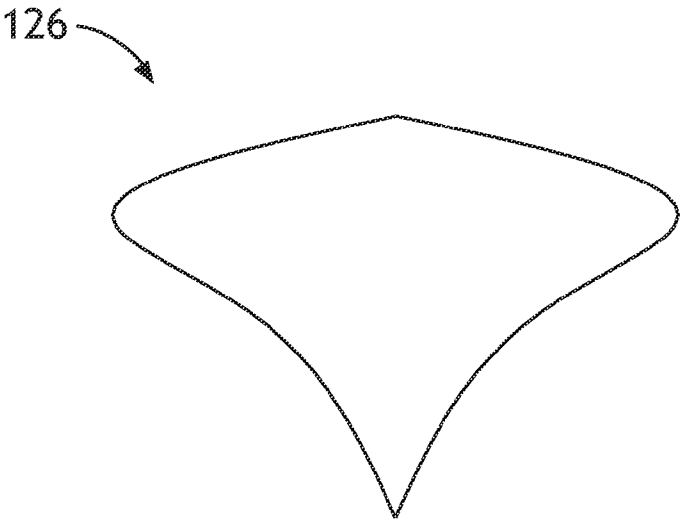
FIG. 2D illustrates design features of the parallel left hull and right hull, in accordance with embodiments of the present invention.

Referring now to FIGS. 2B-2D, a series of bow cross-sectional views suitable for implementation in each of the left and right hulls 101*a*, 101*b* are depicted, in accordance with embodiments of the present invention. In one embodiment, as shown in FIG. 2B, the bow of the left or right hull 101*a*, 101*b* may have a rounded convex "v" shape 124, which acts to provide the desired wave-splitting action. In another embodiment, as shown in FIG. 2C, the bow of the left or right hull 101*a*, 101*b* may have a "v" shape 125, which acts to provide the desired wave-splitting action. In another embodiment, as shown in FIG. 2C, the bow of the left or right hull 101*a*, 101*b* may have a rounded concave "v" shape 126, which acts to produce the desired wave-splitting action.

In a further embodiment, the aforementioned bow shapes of the bow of the left or right hull 101*a*, 101*b* may be further improved with the addition of a bow planing shape and additional displacement volume 150 to avoid pitch-polling. In a further embodiment, the bow of the left or right hull 101*a*, 101*b* may have a low vertical profile to enhance transportability. It is recognized herein that alternative construction methods may include a rotational molded plastic hulls or the attachment of alternative skin surfacing materials, such as molded plastic skins, or other materials.

Figure 3:
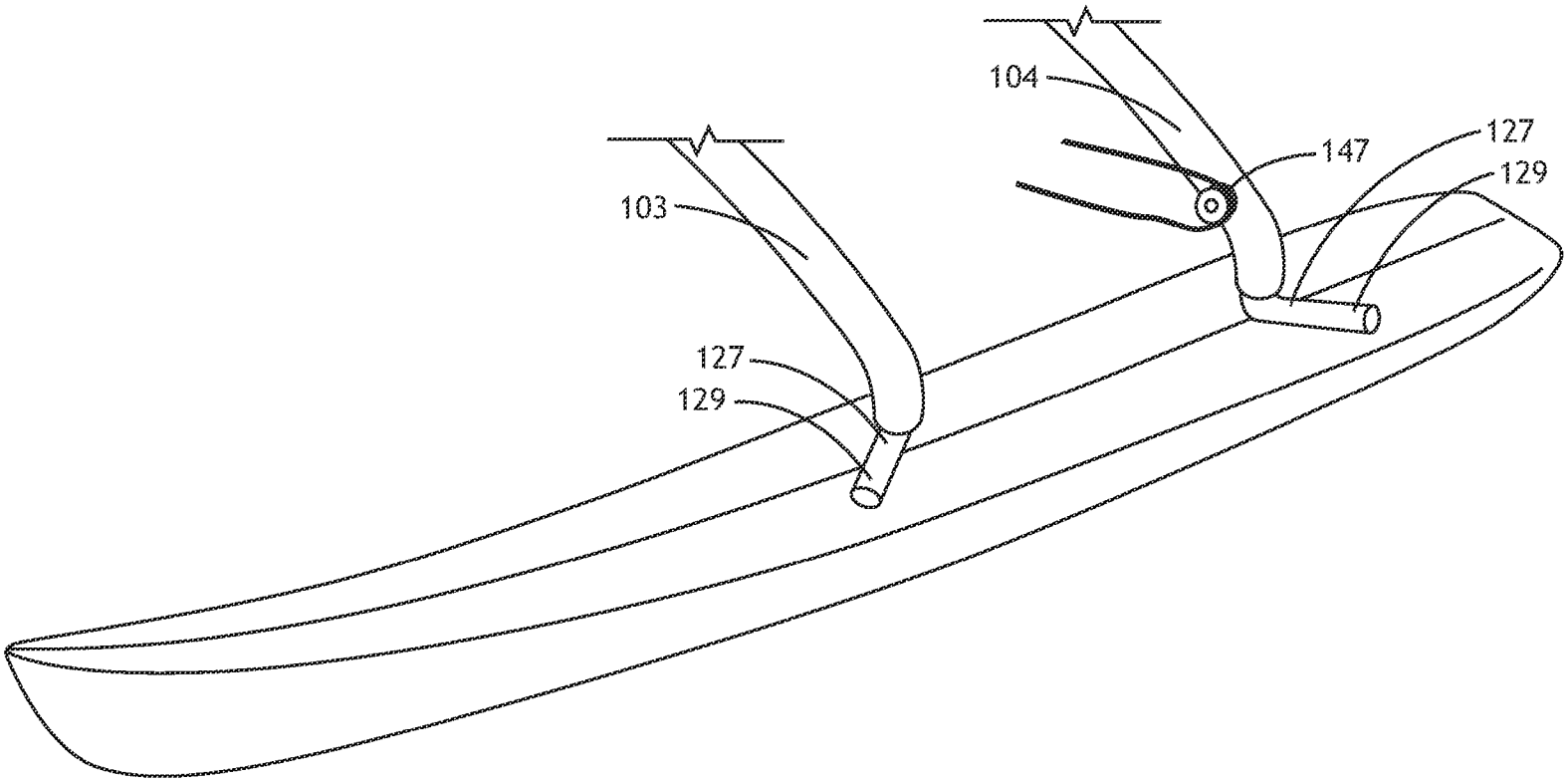
FIG. 3 illustrates a schematic view of the arced fore spar or aft spar, in accordance with one embodiment of the present invention.

FIG. 3 illustrates a schematic view of the arced fore spar 103 or aft spar 104, in accordance with one embodiment of the present invention. As shown in FIG. 3, the spars 103, 104 may include fixed pins 127 protruding from the spars 103, 104, whereby the fixed pins 127 are releasably or reversibly inserted into the hull pin receivers 129. In some embodiments, the arced spars 103, 104 of the sailing vessel 100 of the present invention may be constructed of tubing of a selected material, such as, but not limited to, aluminum or carbon fiber. In a further embodiment, the arced spars 103, 104 may be produced in a variety of cross-sectional shapes utilizing extrusion processes. In a further aspect, the arced spars 103, 104 may be formed or altered with the addition of foam covered with a selected lightweight material, such as fiberglass or carbon fiber skins. In a further embodiment, the jib sheet pulleys 147 of the vessel 100 are also attached to the aft arced spar 104.

Figure 4A:
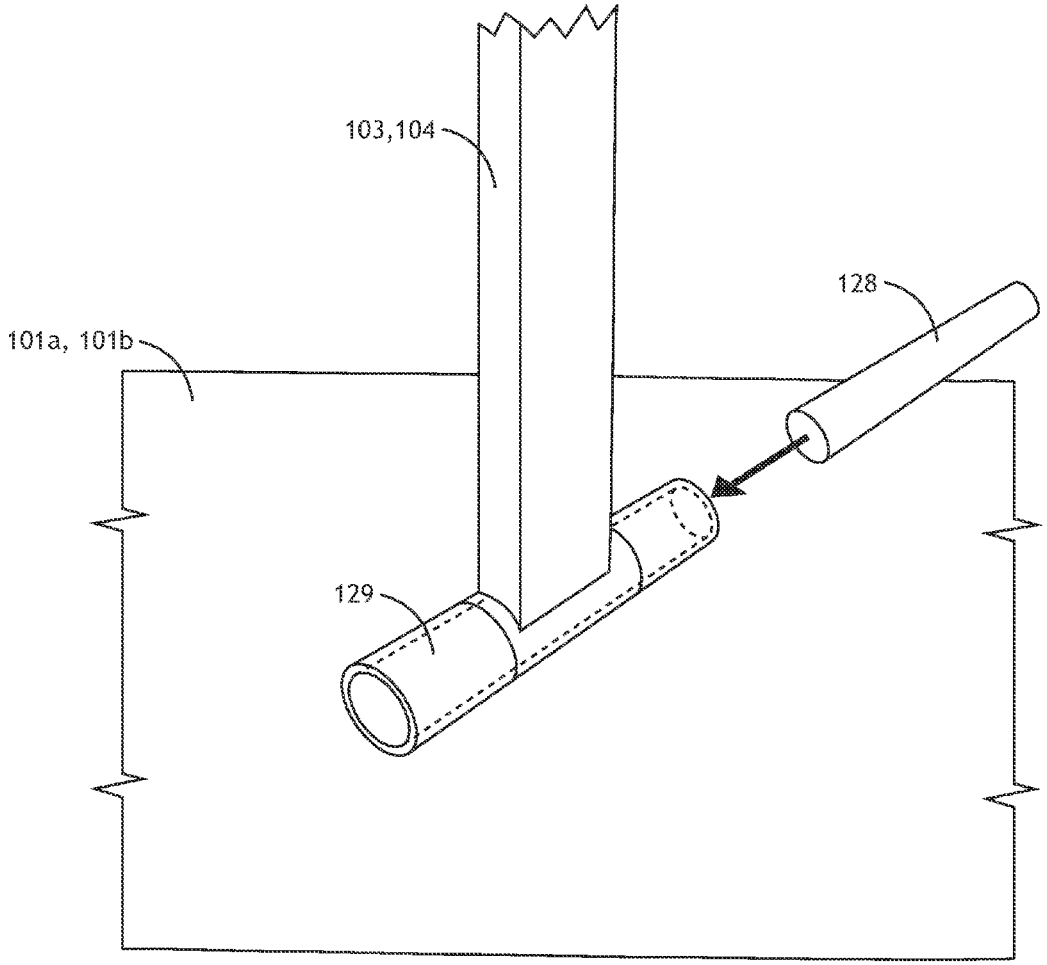
FIG. 4A illustrates a schematic view depicting an opposing fore and aft spar of the vessel equipped with removable pins, in accordance with one embodiment of the present invention.

FIG. 4A illustrates a schematic view depicting an opposing fore and aft spar 103, 104 of the vessel 100 equipped with removable pins 128, in accordance with one embodiment of the present invention. As shown in FIG. 4A, the removable pins 128 of the fore and aft spars 103, 104 are reversibly insertable into the hull pin receivers 129, which are disposed on each of the left and right hulls 101*a*, 101*b*.

Figure 4B:
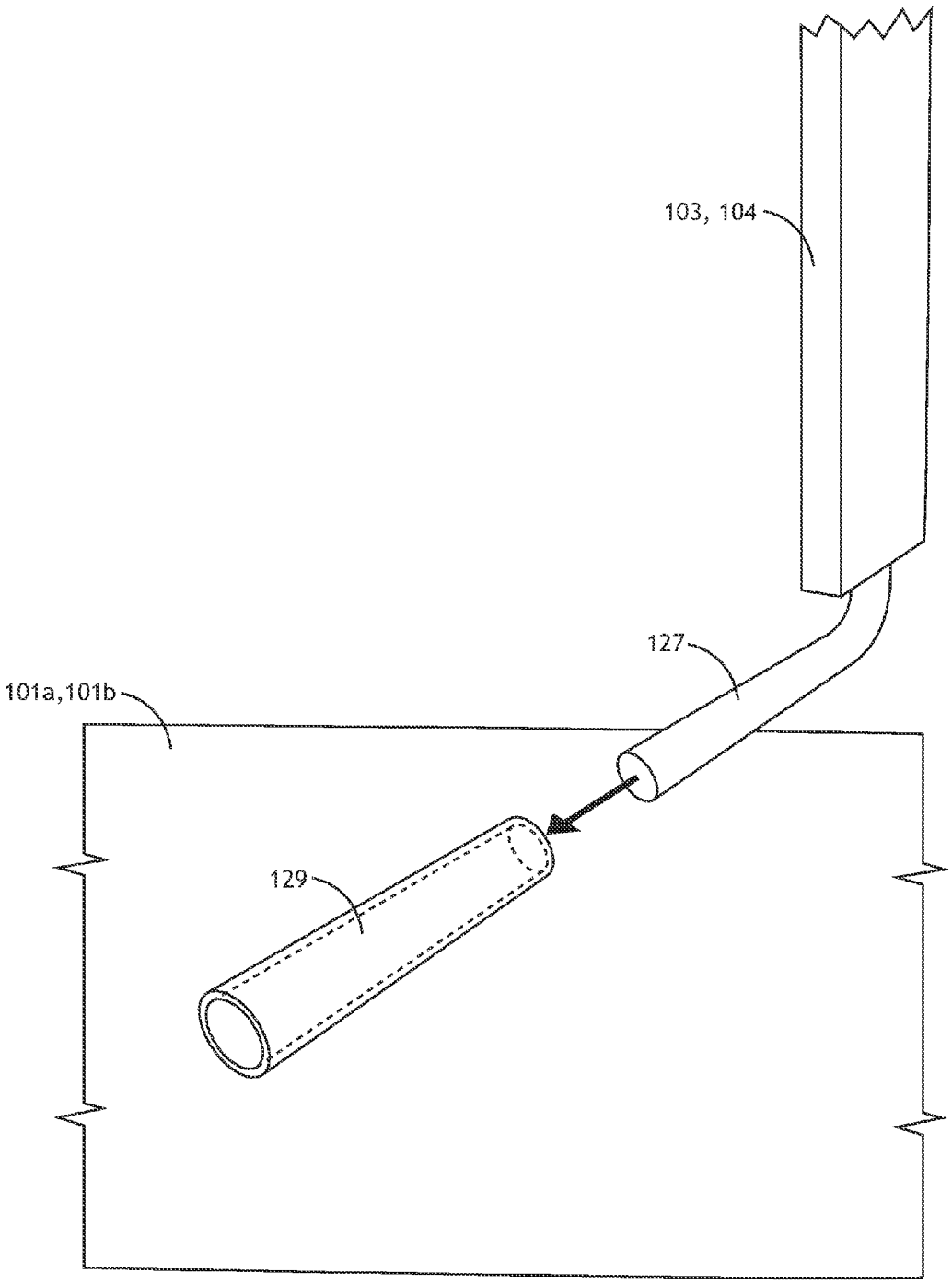
FIG. 4B illustrates a schematic view depicting an opposing fore and aft spar of the vessel equipped with fixed pins, in accordance with one embodiment of the present invention.

FIG. 4B illustrates a schematic view depicting an opposing fore and aft spar 103, 104 of the vessel 100 equipped with fixed pins 127, in accordance with one embodiment of the present invention. As shown in FIG. 4B, the fixed pins 127 of the fore and aft spars 103, 104 are reversibly insertable into the hull pin receivers 129, which are disposed on each of the left and right hulls 101*a*, 101*b*.

Figure 5:
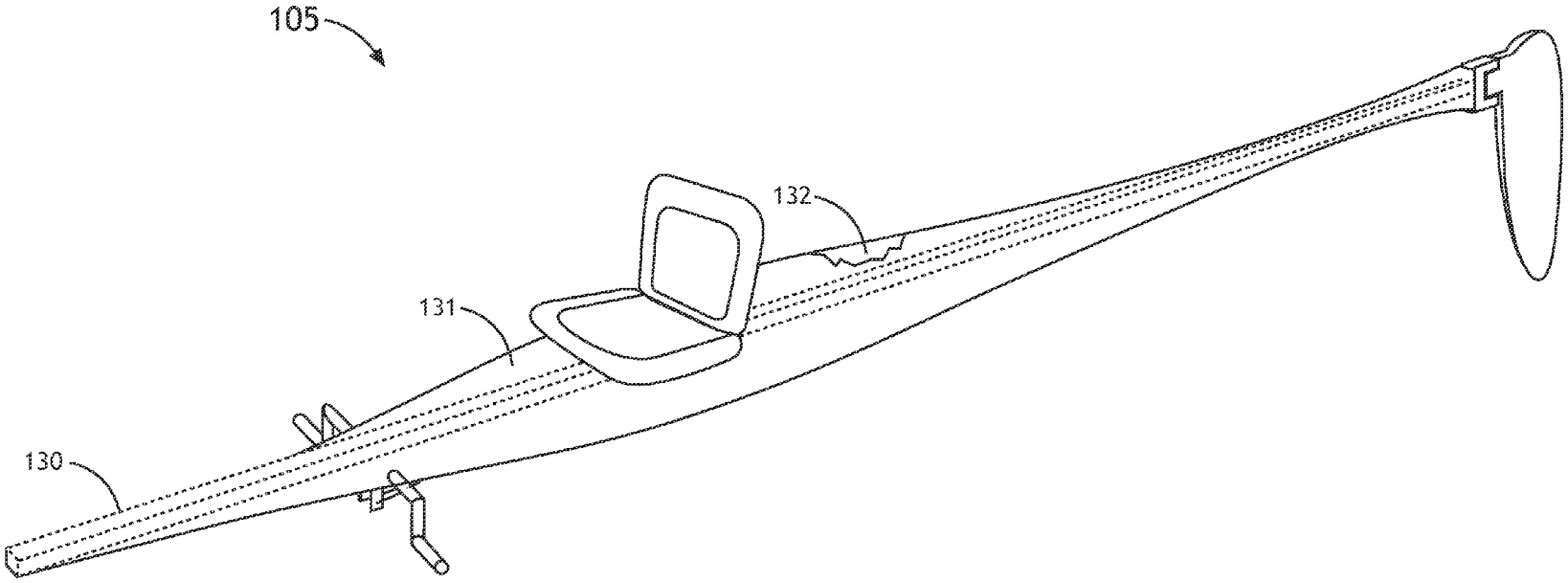
FIG. 5 illustrates a schematic view the central longitudinal body, in accordance with one embodiment of the present invention.

FIG. 5 illustrates a schematic view the central longitudinal body 105, in accordance with one embodiment of the present invention. In one embodiment, the central body 105 includes a longitudinal shaft 130 formed from a selected lightweight material, such as aluminum or carbon fiber, covered with foam 131 and a skin layer 132 (e.g., a fiberglass skin or carbon fiber skin) to produce the desired cross-sectional shape. It is recognized herein that the desired structure and shape of the central body 105 may be alternatively produced with molded fiberglass or carbon fiber. In other embodiments, various recesses, payload compartments, or connecting devices may be built into or attached to the longitudinal body 105 in order to carry payloads.

Figure 6:
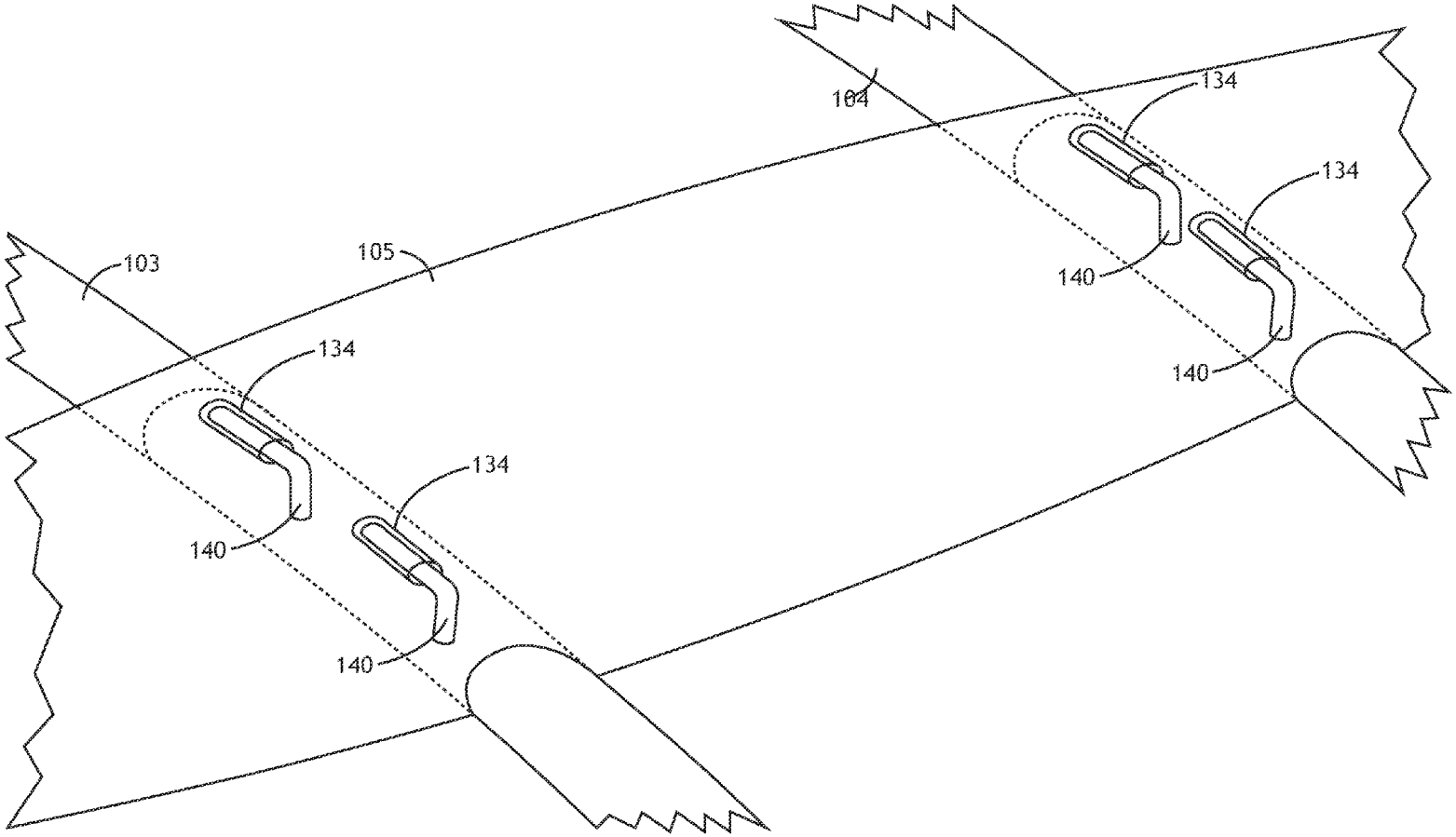
FIG. 6 illustrates a schematic view of the pin receivers of the central longitudinal body releasably fixed over the fixed pins of the arced fore and aft spars.

FIG. 6 illustrates a schematic view of the pin receivers 134 of the central longitudinal body 105 releasably fixed over the fixed pins 140 of the arced fore and aft spars 103, 104. In this regard, pin receiver 134/fixed pin 140 configuration acts to secure the opposing fore and aft arced spars 103, 104 by attaching the spars 103, 104 to the central longitudinal body 105. In a further embodiment, the central body 105 may include a pair of grooves (as shown in FIG. 6) conformed to the profile of the fore and aft spars 103, 104 and suitable for receiving the spars 103, 104. In addition, each the grooves of the central body 105 may include pinholes suitable for receiving the shaft of the pins (e.g., L-shaped pins) disposed on the spars 103, 104. For example, L-shaped pins disposed on the spars 103, 104 may be slid into the pin receivers 134, thereby locking the fore and after spars 103, 104 into the corresponding grooves of the central longitudinal body 105.

Figure 7:
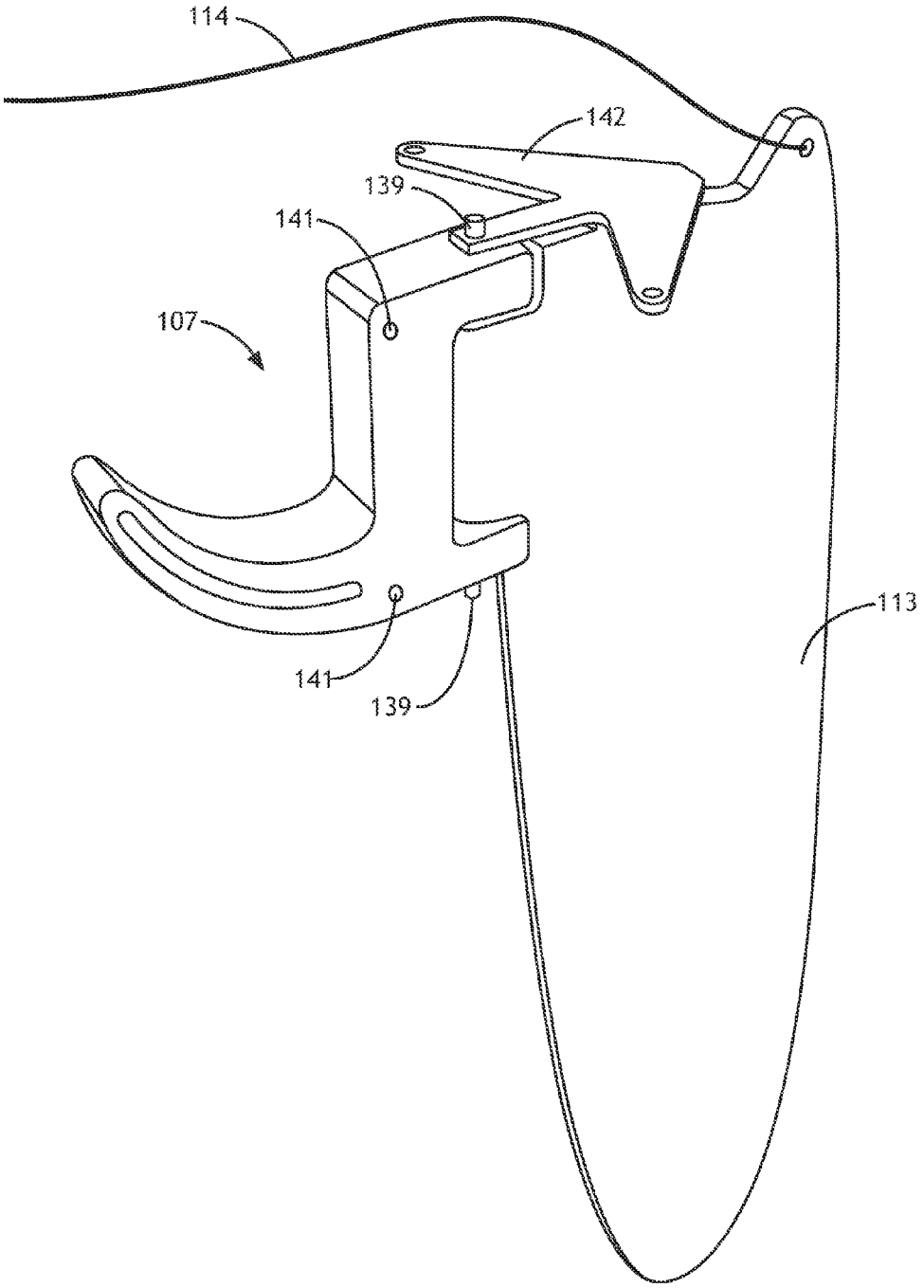
FIG. 7 illustrates a schematic view of the kick-up rudder assembly and rudder in the down position, in accordance with one embodiment of the present invention.

FIG. 7 illustrates a schematic view of the kick-up rudder assembly 107 and rudder 113 in the down position, in accordance with one embodiment of the present invention. In one embodiment, the rudder assembly 107 is attached to the central longitudinal body 105 with one or more releasable pivot pins 141. In another embodiment, the vessel 100 may include a retracting control line 114 attached to the rudder 113, which terminates near the crew seat 108. In another embodiment, the rudder steering arm 142 is attached to the rudder 113 and the foot pedal steering assembly 109. In another embodiment, the rudder 113 is releasably attached to the kick-up rudder assembly 107 with a pin 139. In some embodiments, the kick-up rudder assembly 107 and rudder 113 may be constructed of any material known in the art, such as, but not limited to, wood, fiberglass, or carbon-fiber.

Figure 8:
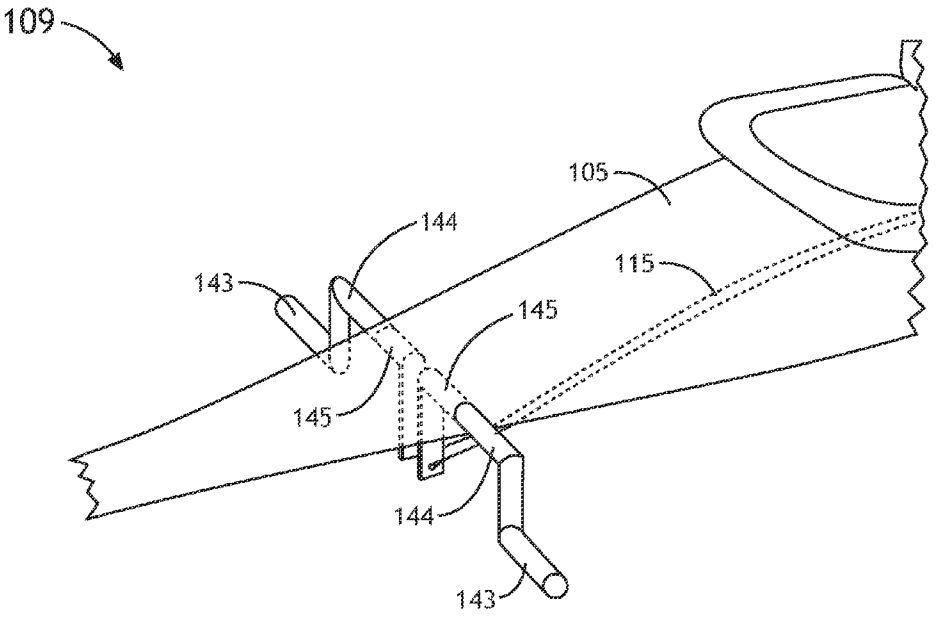
FIG. 8 is a schematic view of the foot pedal steering assembly releasably attached to the central longitudinal body, in accordance with one embodiment of the present invention.

FIG. 8 is a schematic view of the foot pedal steering assembly 109 releasably attached to the central longitudinal body 105. In one embodiment, the foot pedal steering assembly 109 includes left and right foot pedals 143, a pivot pin 144, a pivot pin receiver 145, and control lines 115 releasably attached to the foot pedals 143. The "kick-up rudder assembly" 107 and foot pedal steering assembly 109 attached to the central longitudinal body 105 allow the crew to control the vessel 100 with both hands free, allowing the crew to control the main sheet and jib sheet further improving operation simplicity, unlike traditional sailboat designs which require the use of hands for both steering, sail control and jib control.

The sailing vessel 100 is reversibly assembled using various assembly procedures. In a first step, the removable fixed pins 127 (or arced fore and aft spar fixed pins 128) into the hull pin receivers 129, as illustrated in FIGS. 4A and 4B. In a second step, the central longitudinal body 105, which may carry the mast base 106, kick-up rudder assembly 107, rudder 113, collapsible seat 108, and steering assembly 109, is releasably attached to the fore and aft spars 103, 104 by sliding the central longitudinal body 5 and pin receivers 34 over the spar fixed pins 140, as illustrated in FIG. 6. In a third step, the mast 110 is releasably attached to the mast base 106 and the side stays 111 and forestay 112 are releasably attached to the aft spar 104 and central longitudinal body 105 by means of stay adjusters, and clevis pins. In a fourth step, the mainsail 137 is raised and the self-furling jib 138 is unfurled to complete the assembly. In a like manner, Applicant notes that the sailing vessel 100 may be disassembled from the fully assembled state.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

What is claimed:

1. A wind-powered sailing vessel comprising:

a plurality of parallel hulls;

a plurality of cross-member spars releasably connected to the parallel hulls;

a central longitudinal body centrally releasably connected to the plurality of cross-member spars, the central longitudinal body elevated above water during operation of the wind-powered sailing vessel;

a crew seat releasably connected to the central longitudinal body at a location forward of a mast position, wherein the sailing vessel has a center of gravity located behind the center of hull buoyancy;

a kick-up rudder assembly releasably connected to the central longitudinal body such that the kick-up rudder assembly is elevated above water during operation of the wind-powered sailing vessel; and a rudder releasably connected to the kick-up rudder assembly, wherein the rudder is configured to at least partially submerge in water during operation of the wind-powered sailing vessel.

2. The sailing vessel of claim 1, further comprising:

a foot pedal steering system releasably connected to the central longitudinal body.

3. The sailing vessel of claim 1, further comprising:

a main sail on a mast located at the mast position.

4. The sailing vessel of claim 3, further comprising:

a jib.

5. The sailing vessel of claim 1, wherein at least one of the parallel hulls includes a recessed pin receiving assembly for connection to a plurality of cross-member spars releasably connecting the parallel hulls.

6. The sailing vessel of claim 1, wherein the parallel hulls are configured for movement in at least partial independence relative to the central longitudinal body in order to maintain oscillations produced by wave action below a selected level.

7. The sailing vessel of claim 1, wherein one or more of the cross-member spars have an arch shape.

8. The sailing vessel of claim 1, wherein the plurality of cross-member spars includes a fore cross-member spar and an aft cross-member spar.

9. The sailing vessel of claim 1, further comprising:

one or more coupling devices for coupling the plurality of cross-member spars to the plurality of parallel hulls.

10. The sailing vessel of claim 9, wherein the one or more coupling devices include one or more pin-receiver assemblies.

11. The sailing vessel of claim 9, wherein the one or more coupling devices include at least one of one or more straps, one or more removable pins, one or more hook and loop devices.

12. A wind-powered sailing vessel comprising:

a plurality of parallel hulls;

a plurality of cross-member spars releasably connected to the parallel hulls;

a central longitudinal body centrally releasably connected to the plurality of cross-member spars, the central longitudinal body elevated above water during operation of the wind-powered sailing vessel;

a crew seat releasably connected to the central longitudinal body at a location forward of a mast position, wherein the plurality of parallel hulls, the central longitudinal body and the crew seat are configured such that the sailing vessel has a center of gravity located behind the center of hull buoyancy during operation of the sailing vessel; and a kick-up rudder assembly releasably connected to the central longitudinal body such that the kick-up rudder assembly is elevated above water during operation of the wind-powered sailing vessel.

13. The sailing vessel of claim 12, further comprising:

a rudder releasably connected to the kick-up rudder assembly, wherein the rudder is configured to at least partially submerge in water during operation of the wind-powered sailing vessel.

14. The sailing vessel of claim 12, further comprising:

a foot pedal steering system releasably connected to the central longitudinal body.

15. The sailing vessel of claim 12, further comprising:

a main sail on a mast located at the mast position.

16. The sailing vessel of claim 15, further comprising:

a jib.

17. A wind-powered sailing vessel comprising:

a plurality of parallel hulls;

a plurality of cross-member spars releasably connected to the parallel hulls;

a central longitudinal body centrally releasably connected to the plurality of cross-member spars, the central longitudinal body elevated above water during operation of the wind-powered sailing vessel;

a crew seat releasably connected to the central longitudinal body at a location forward of a mast position, wherein the plurality of parallel hulls, the central longitudinal body and the crew seat are configured such that the sailing vessel has a center of gravity located behind the center of hull buoyancy during operation of the sailing vessel;

a kick-up rudder assembly releasably connected to the central longitudinal body such that the kick-up rudder assembly is elevated above water during operation of the wind-powered sailing vessel; and a rudder releasably connected to the kick-up rudder assembly, wherein the rudder is configured to at least partially submerge in water during operation of the wind-powered sailing vessel.

18. The sailing vessel of claim 17, further comprising:

a foot pedal steering system releasably connected to the central longitudinal body.

19. The sailing vessel of claim 17, further comprising:

a main sail on a mast located at the mast position.

20. The sailing vessel of claim 19, further comprising:

a jib.

* * * * *